US005635923A

United States Patent [19]

Steele et al.

[11] Patent Number: 5,635,923

[45] Date of Patent: Jun. 3, 1997

[54] RECEIVER FOR USE IN A REMOTE KEYLESS ENTRY SYSTEM AND FOR RECEIVING PUBLIC BROADCASTS

[75] Inventors: Russell W. Steele, Nevada City, Nev.; Thomas R. Krause, Troy, Mich.; George P. Lambropoulos, Grosse Pointe Woods, Mich.; Carl A. Munch, Southfield, Mich.

[73] Assignee: TRW Inc., Lyndhurst, Ohio

[21] Appl. No.: 541,188

[22] Filed: Oct. 11, 1995

Related U.S. Application Data

[63] Continuation of Ser. No. 134,074, Oct. 8, 1993, abandoned.

[51] Int. Cl.[6] ..... G08G 1/00

[52] U.S. Cl. ..... 340/905; 340/902; 340/426; 340/825.32; 307/10.2; 180/287

[58] Field of Search ..... 340/902, 900, 340/905, 426, 825.31, 825.32; 307/10.2, 10.3, 10.4; 180/287

[56] References Cited

U.S. PATENT DOCUMENTS

| | | | |
|---|---|---|---|
| 3,293,600 | 12/1966 | Gifft | 340/903 |
| 3,371,278 | 2/1968 | Gelushia et al. | 340/902 |
| 3,646,508 | 2/1972 | Da Silva | 340/901 |
| 3,673,560 | 6/1972 | Barsh et al. | 340/901 |
| 3,760,349 | 9/1973 | Keister et al. | 340/902 |
| 3,784,970 | 1/1974 | Simpkin | 340/902 |
| 3,854,119 | 12/1974 | Friedman et al. | 340/902 |
| 3,899,671 | 8/1975 | Stover | 340/905 |
| 4,670,746 | 6/1987 | Taniguchi et al. | 340/825.31 |
| 4,763,121 | 8/1988 | Tomoda et al. | 340/825.54 |
| 4,764,978 | 8/1988 | Argo et al. | 340/902 |
| 4,794,394 | 12/1988 | Helstead | 340/903 |
| 4,841,302 | 6/1989 | Henry | 340/905 |
| 4,862,513 | 8/1989 | Bragas | 340/905 |
| 4,881,148 | 11/1989 | Lambropoulos et al. | 361/172 |
| 5,278,547 | 1/1994 | Sumon et al. | 340/426 |
| 5,289,183 | 2/1994 | Hassett et al. | 340/905 |
| 5,307,060 | 4/1994 | Prevulsky et al. | 340/903 |

*Primary Examiner*—Thomas Mullen
*Assistant Examiner*—Edward Lefkowitz
*Attorney, Agent, or Firm*—Tarolli, Sundheim, Covell, Tummino & Szabo

[57] ABSTRACT

A remote keyless entry vehicle receiver includes a memory that stores a security code for uniquely identifying a transmitter that is authorized entry into the vehicle. The memory also stores a broadcast code that identifies a broadcast message intended for general use by a group of vehicles, each being equipped with a similar receiver. A signal is received which includes at least a coded portion. The received coded portion is compared with each of the codes that are stored in memory. Vehicle entry is permitted when the received signal includes a coded portion that matches the stored security code. The driver is alerted and/or provided with a message when the received signal includes a coded portion that matches the stored broadcast code.

11 Claims, 3 Drawing Sheets

RECEIVER FOR USE IN A REMOTE KEYLESS ENTRY SYSTEM AND FOR RECEIVING PUBLIC BROADCASTS

This is a continuation of application Ser. No. 08/134,074 filed on Oct. 8, 1993 now abandoned.

FIELD OF THE INVENTION

The present invention relates to the art of remote keyless entry systems and, more particularly, to a receiver for use in such systems as well as for use in receiving a public broadcast which may include information for advising a vehicle operator of traffic and/or roadway conditions and the like.

DESCRIPTION OF THE PRIOR ART

Radio broadcast systems are known for providing traffic and roadway advisory messages to vehicle operators. Such systems are used by entertainment complexes and the like and frequently include roadside transmitters which repeatedly transmit recorded traffic messages to arriving vehicles. These broadcast messages are typically broadcast over an RF frequency and a visitor merely tunes a standard radio receiver to the frequency containing the recorded message. It is also known to provide emergency vehicles, such as ambulances and the like, with special transmitting equipment to broadcast messages to other nearby vehicles providing information that the emergency vehicle is approaching.

Keyless entry systems for motor vehicles are also known in the art and typically control the locking-unlocking functions of a motor vehicle door lock. Such systems include a receiver mounted on a vehicle and one or more portable handheld transmitters located remote from the receiver. The receiver has a memory which stores one or more identification or security codes, each of which identifies a particular transmitter. Each transmitter may be provided with a plurality of manually actuatable switches, each representative of a control function to be performed, such as unlock or lock the vehicle door. The transmitter includes circuitry that responds to the actuation of one of the switches to transmit a digital signal which includes an identification or security code that uniquely identifies the transmitter from that of a plurality of similar transmitters, along with a function code representative of a particular function to be performed, such as unlock a door. When a receiver receives such a digital signal, it compares the received security code with each of a plurality of stored security codes to determine if a match exists indicative that the receiver may validly receive the digital signal and respond thereto. If a match takes place, the receiver responds to the function code by causing performance of the control function requested, such as unlock the vehicle door. A system as described above is disclosed in U.S. Pat. No. 4,881,148, the disclosure of which is herein incorporated by reference.

Other keyless entry systems include the U.S. Patent to Tomoda et al. U.S. Pat. No. 4,763,121 and the U.S. Patent to Taniguchi et al. U.S. Pat. No. 4,670,746. These patents disclose systems for unlocking vehicle doors without the need for any manual operation of pushbuttons located on remote transmitters or the like. Instead, each remote device takes the form of a transceiver which receives demand signals which are periodically transmitted by a vehicle mounted transceiver. The remote transceiver then sends a reply signal to the vehicle transceiver wherein the reply signal includes a preset code. The preset code corresponds with the security or identification codes discussed hereinabove. At the vehicle transceiver, the preset code received from a remote transceiver is compared with a stored preset code. If a match takes place, the requested control function such as unlock a vehicle door is accomplished.

SUMMARY OF THE INVENTION

In accordance with one aspect of the invention, a vehicle receiver is provided which is adapted to be mounted to a motor vehicle for use in a remote keyless entry system. The receiver includes a memory for storing at least one security code that uniquely identifies a transmitter that is authorized entry into the vehicle and also for storing a broadcast code that identifies a broadcast message that is generated for general use by at least a group of vehicles each of which is equipped with a receiver. The receiver includes circuitry for receiving an RF signal having at least a coded portion. The coded portion is compared with each of the stored codes. Vehicle access is controlled based on whether the received signal includes a coded portion that matches the stored security code. Additionally, the receiver controls the provision of a driver message when the received signal includes a coded portion that matches the stored broadcast code.

BRIEF DESCRIPTION OF THE DRAWINGS

The foregoing and other objects of the invention will become more readily apparent from the following description of the preferred embodiment of the invention as taken in conjunction with the accompanying drawings which are a part hereof and wherein.

DESCRIPTION OF PREFERRED EMBODIMENT

Reference is made to the drawings wherein the showings are for purposes of illustrating a preferred embodiment of the invention only, and not for the purpose of limiting same.

Figure 1:
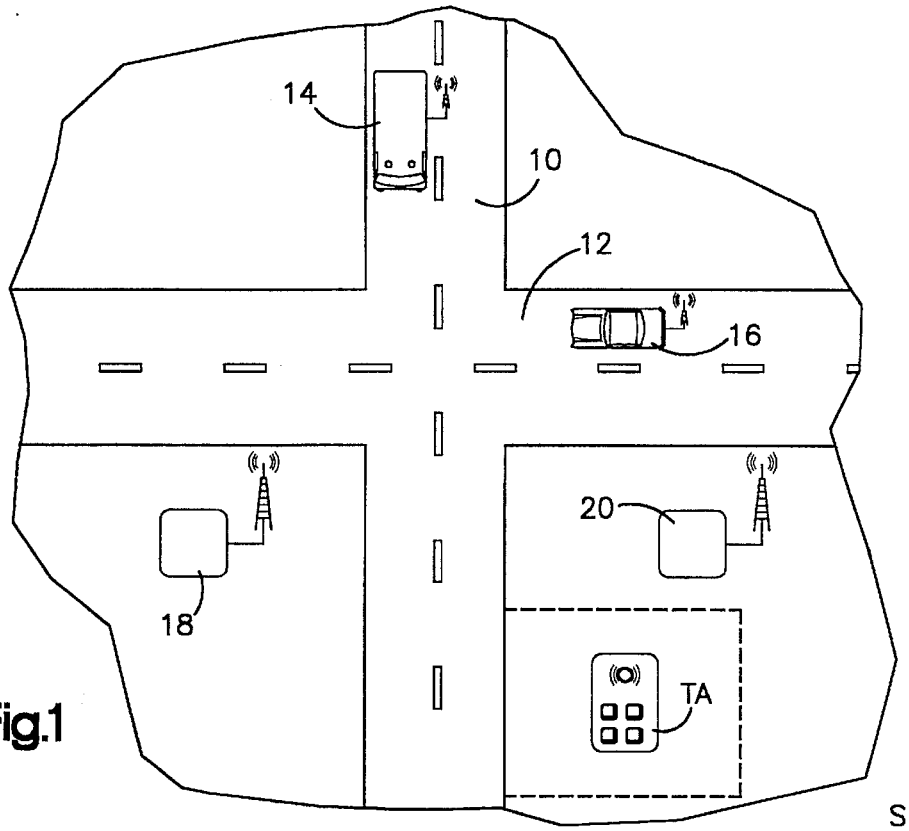
FIG. 1 is a plan view of two intersecting streets and a nearby parking lot and which illustrates applications of the present invention.

Reference is made to FIG. 1 which illustrates one application of the present invention with reference to an intersection of two traffic streets 10 and 12. An emergency vehicle 14 is illustrated as moving in a southward direction on street 10 approaching the intersection. A normal vehicle 16 is located on street 12 and is moving in a westward direction toward the same intersection. In accordance with the present invention, it is contemplated that the emergency vehicle 14 is equipped with a transmitter which may transmit an RF signal including a broadcast code and a message indicating that the emergency vehicle is in the vicinity and that other vehicles should be on alert. The present invention also contemplates the provision of roadside transmitters, such as transmitters 18 and 20 which are equipped with transmitters that periodically transmit driver alert messages warning of dangerous road conditions and the like. It is also contemplated that these roadside transmitters will be equipped with transmitters which will transmit a broadcast code together with a message representative of the road condition of concern.

In accordance with the present invention, the vehicle 16 is equipped with a remote keyless entry system (RKE) and, specifically, includes an RKE receiver. As will be brought out hereinafter, such a receiver is mounted on a vehicle and normally serves to receive from a portable RKE transmitter TA a coded signal uniquely identifying the transmitter and operation to request a particular vehicle operation such as unlocking of the vehicle doors. In such case, the receiver in the motor vehicle 16 responds to the unique code to perform a commanded function, such as unlocking of the vehicle doors.

In accordance with the present invention, the RKE receiver provided in vehicle 16 also receives, on the same frequency carrier as the RKE signal, the broadcast code transmitted by the emergency vehicle 14 or by one of the roadside transmitters 18 and 20 to alert the driver of the vehicle 16 of an approaching emergency vehicle or of a dangerous road condition or the like. These transmitters include circuits corresponding to the transmitter TA described hereinafter.

As will be brought out in greater detail hereinafter, each RKE receiver includes a memory that stores one or more security codes each of which uniquely identifies a transmitter that is authorized entry into the vehicle. One such transmitter TA is shown in FIG. 1 and is permitted entry into vehicle 16. Other, similar transmitters TB (not shown) may also be permitted entry into vehicle 16. Additionally, the memory stores a broadcast code that identifies a broadcast message generated for general or public use by vehicles equipped with RKE receivers. This will permit reception and recognition of broadcast codes by all such receivers to alert such a vehicle driver to an approaching emergency vehicle or road conditions ahead. When the received signal includes a coded portion that matches the stored security code, then the RKE receiver initiates action to perform a commanded vehicle operation such as a vehicle lock-unlock function. When the received signal includes a coded portion that matches the stored broadcast code, then the receiver initiates action to provide a suitable message to the driver.

Having briefly described a system, attention is now directed to a more detailed description of a portable RKE transmitter as well as a vehicle mounted RKE receiver constructed in accordance with the present invention.

Portable Transmitter

Figure 2:
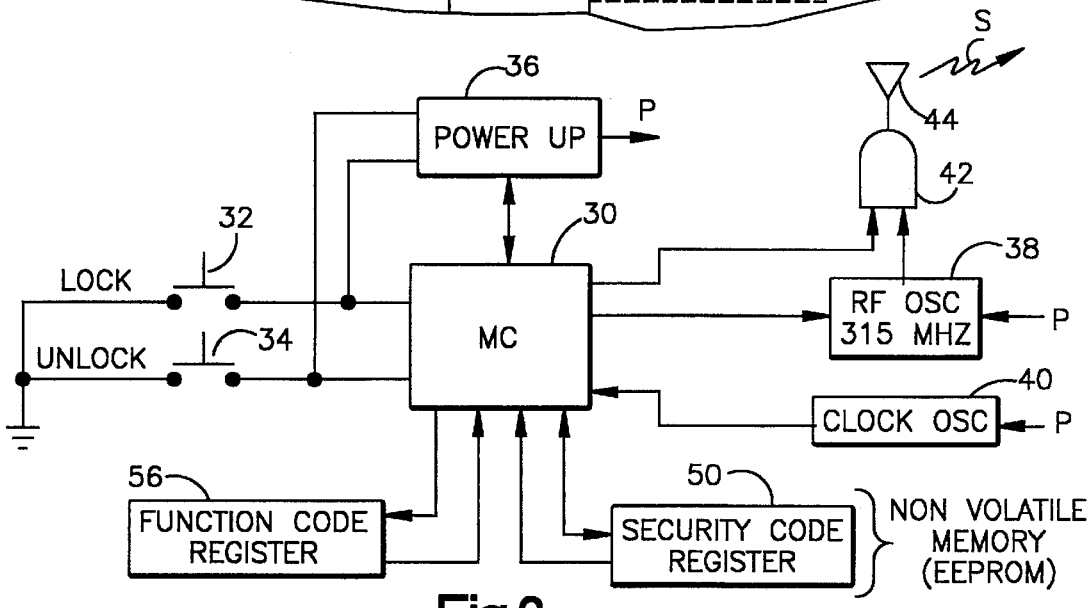
FIG. 2 is a schematic-block diagram illustration of a portable transmitter which may be employed in practicing the present invention.

Each portable RKE transmitter may take the form of transmitter TA illustrated in FIG. 2. Transmitter TA includes a microcomputer 30 having appropriate internal ROMs, EEPROMs and RAMs programmed to perform the functions of the system, as herein described, and having sufficient I/O terminals for interconnection with input and output peripherals. The transmitter TA also includes a pair of manually operable pushbutton switches 32 and 34. Upon pressing one of these switches 32 and 34, a power up circuit 36 is actuated to direct power P to the microcomputer 30 and actuate oscillators 38 and 40. Actuation of one of these switches causes a transmission of an RF signal which, as will be described hereinafter, includes a coded security portion and a function portion.

The oscillator 38 has a nominal frequency of 315 MHz, which frequency is essentially the same frequency employed for common garage door operators. The clock oscillator 40 is unregulated and does not have a crystal control and may vary as to its frequency with temperature changes and manufacturing tolerances. The output of oscillator 40 is used to time the function of microcomputer 30 to control the binary signals transmitted by the antenna 44 under control of an AND gate 42. One input to this AND gate 42 is taken from the microcomputer 30 and the second is taken from the oscillator 38. The output is a series of binary conditions (logic 0, logic 1) superimposed on a 315 MHz carrier. This forms the amplitude modulated transmitted signal S. The code in signal S is binary with a binary 1 and a binary 0 being distinguished from each other by having a difference in length or duration.

The microcomputer 30 of the transmitter TA includes several internal memories sometimes referred to as registers. Whereas these registers are internal of the microcomputer, some registers are illustrated in FIG. 2 to assist in the description herein. These include a security code register 50. This register is preferably located in the EEPROM memory. An additional register illustrated in FIG. 2 includes a function code register 56. Register 56 may be located in RAM. The security code register 50 contains a code which uniquely identifies the transmitter TA and thus distinguishes it from other, similar transmitters. The vehicle mounted RKE receiver C located in vehicle 16, in the example being presented herein, may permit several selected transmitters to have valid entry into the vehicle. These may include, for example, transmitters TA and TB. Only transmitter TA is illustrated herein, but transmitter TB is identical, except for its security code. The security code register 50 in transmitter TA stores a security code which is fixed in the transmitter at the time of the manufacturer and this may be accomplished in the manner described in U.S. Pat. No. 4,881,148. The security code preferably takes the form of four eight bit bytes. A similar security code is provided in a security code register in transmitter TB.

The function code register 56 stores the function code to be transmitted as part of the transmitted signal from the transmitter TA to the vehicle mounted receiver C. This function code preferably takes the form of an eight bit, coded byte with the bits being arranged to represent the function being requested, such as "unlock the vehicle door" or "lock the vehicle door".

The signal transmitted by the transmitter TA has a range on the order of fifty feet. The transmitted signal includes a start portion 60 which may include four bits, a security portion 62 which includes four, eight bit bytes and a function code portion which includes eight bits. This may be followed by a checksum code, as is common in the art.

Vehicle RKE Receiver

The vehicle RKE receiver C (FIG. 4) includes an RF detector 70 tuned to the transmitter signal frequency of 315 MHz. As the signal S is received at the receiver's antenna 71, the detector 70 recognizes the frequency of the signal and allows the first portion 60 (FIG. 3) to pass to a wake up signal detector 72. Detector 72 checks to see if the BAUD rate is proper. If the BAUD rate is proper, detector 72 activates a wake up circuit 74 which responds by supplying operating voltage $V_{cc}$, such as 5.0 volts, to the receiver's microcomputer 80. The operating voltage is monitored by a low voltage detector 82 to permit operation of the circuitry so long as the voltage does not drop below a selected level.

The data in the received signal is supplied to the microcomputer 80 from detector 70 through the intermediate circuits 72 and 74. The data into microcomputer 80 is clocked in by clock pulses obtained from a clock oscillator 84. Microcomputer 80, as in the case of microcomputer 30 in the transmitter TA, includes a plurality of internal memories including ROMs, RAMs and EEPROMs. The internal ROM is loaded at the time of manufacture with a program which causes microcomputer 80 to perform the functions to be described in greater detail hereinafter.

Figure 3:
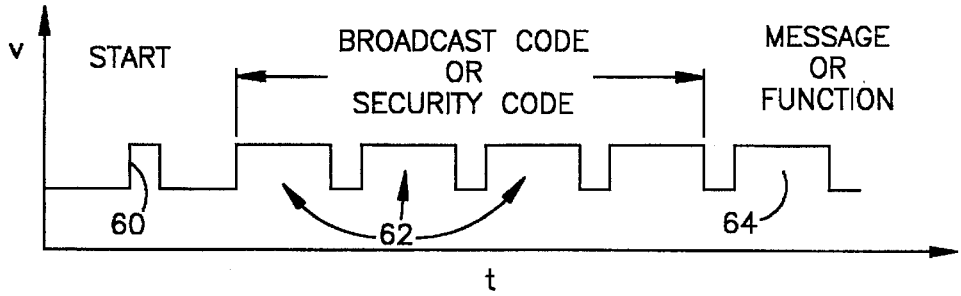
FIG. 3 is an illustration of voltage with respect to time illustrating the waveform of a signal that may be received by the receiver of FIG. 4.
Figure 4:
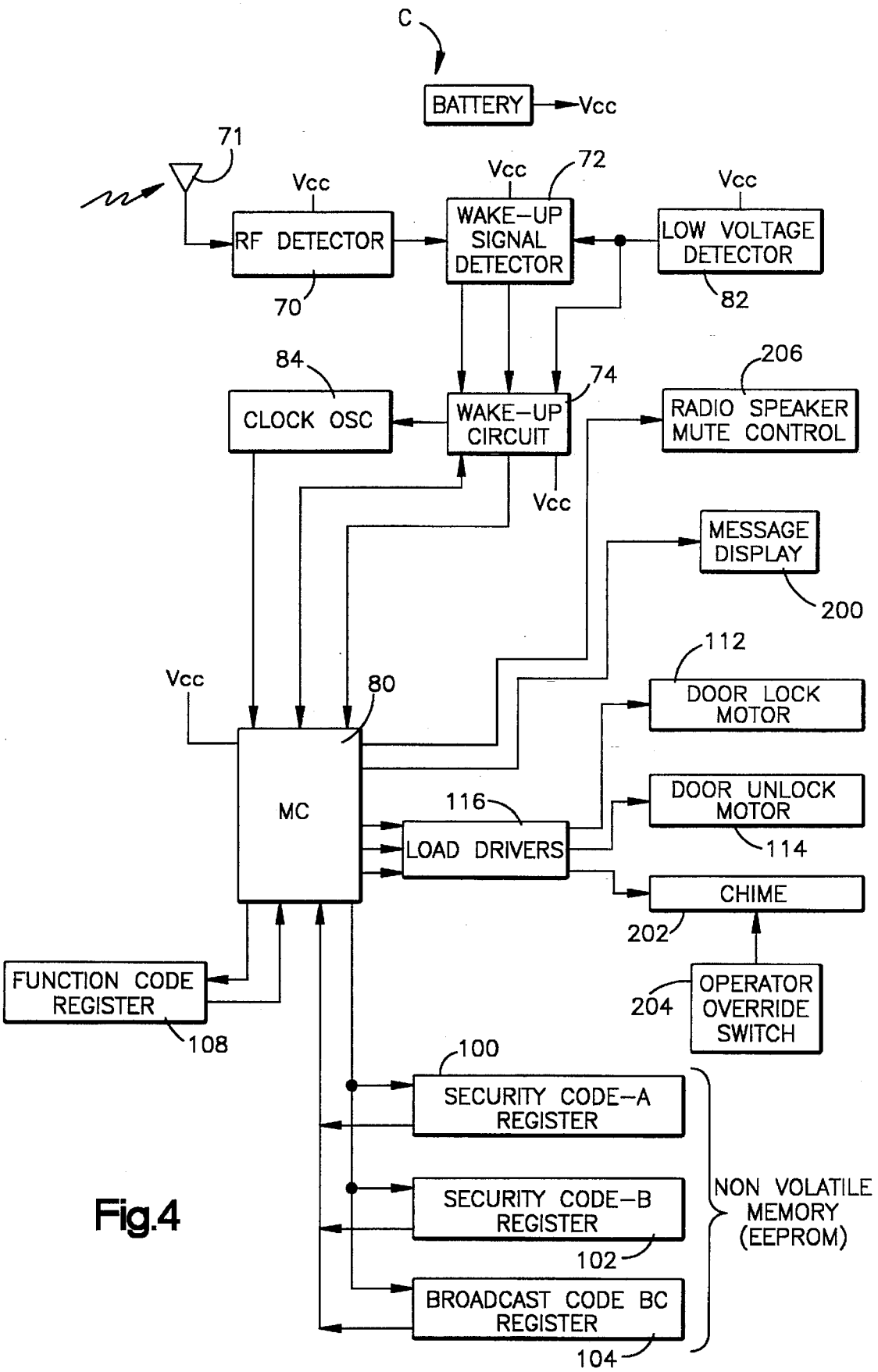
FIG. 4 is a schematic-block diagram illustration of a receiver constructed in accordance with the present invention.

Some of the internal memories, sometimes referred to as registers, of the microcomputer 80 are illustrated in FIG. 4 to assist in the description of the invention. These includes registers 100, 102 and 104, all of which preferably take the form of electrically programmable nonvolatile memory (EEPROM). Register 100 stores a security code SC-A that uniquely identifies one of the transmitters TA from which the vehicle receiver C may validly receive a digital command signal. The code set into register 100 may be placed in the memory at the factory or may be programmed in the field in the manner as described in U.S. Pat. No. 4,881,148. The security code is generated by means of an algorithm which has the capability of generating numbers in a random, but not repeatable, fashion. This code is preferably 32 bits in length and is divided into four eight bit data bytes (see the security code portion 62 in FIG. 3). As it may be desirable for vehicle receiver C to validly receive digital signals from more than one portable transmitter, a second security code register 102 is provided, identical to register 100, but which includes a security code SC-B corresponding to the code stored in the security code register of transmitter TB. An example of an application for security codes assigned to two different portable transmitters is a vehicle receiver C for use with two drivers who are each authorized to use the vehicle containing receiver C. There may be several valid drivers, commonly different members of a family, and each member will then carry a different portable transmitter with its own unique security code. At the vehicle receiver C, each security code will be stored in a corresponding security code register. In the example being described, vehicle receiver C has two security code registers 100 and 102, however the number of registers may be increased to any desired extent. It is contemplated that transmitters TA and TB may validly gain entry into the vehicle containing receiver C.

In addition to registers 100 and 102, the vehicle receiver C includes a broadcast code register 104 which contains a broadcast code BC identifying a broadcast message intended for general use by vehicles equipped with similar RKE receivers. This will be described in greater detail hereinafter.

The receiver C also includes a function code register 108. This is a temporary memory and serves to receive and temporarily store the function code portion of the digital signal received from a portable transmitter, such as transmitter TA. If the receiver C properly receives a valid security code from the transmitter TA, it will decode the function code stored in register 108 and perform the requested function, such as locking or unlocking a vehicle door by way of suitable door lock and unlock motors 112 and 114 driven by load drivers 116 under the control of the microcomputer 80.

In accordance with the present invention, the RKE receiver C may receive not only a signal S which incorporates a security code and a function code, as discussed hereinabove, but also may receive a similar signal S wherein the security code is replaced by a broadcast code and the function code is replaced by a message. This is shown in FIG. 3 wherein the code portion 62 is indicated as being either a broadcast code or a security code. It is contemplated that all emergency vehicles, such as emergency vehicle 14, and all roadside transmitters, such as transmitters 18 and 20, which are to communicate with an RKE receiver will transmit a signal which includes a start portion, followed by a broadcast code and a message. The broadcast code will be common to all such transmitters and all RKE receivers. These transmitters include circuitry corresponding with that in transmitter TA, described above. All vehicles equipped with an RKE receiver will be able to receive a common broadcast code which alerts the receiver that a message will follow and then delivers a public message or information to the driver. This public message may alert the driver to such events as an approaching emergency vehicle or to the existence of a hazard condition in the vicinity. The message is read and stored in a temporary memory, such as in register 108, or in another suitable memory in the microcomputer 80.

The message that follows the broadcast code may be of variable length and is not restricted to an eight bit code as in the manner of the function code described hereinabove. Instead, the message may include sufficient information to provide the display of a message having several characters, such as twenty characters. Consequently, the message portion may be made up of several eight bit ASCII characters which may be decoded in a conventional fashion for operating a visual message display 200 which may be located in the vehicle. It is contemplated that the message display 200 will be located within the view of the driver, such as on the vehicle dashboard. The message display should be large enough to display several characters, e.g. twenty, to provide a human readable message to a driver. Additionally, the microcomputer 80 is programmed to provide an audible alert to the driver that a message is being displayed by activating a suitable audio chime 202. This will alert the driver so that he will then note the message being displayed on the message display 200. The chime will be turned on for a fixed time duration. However, an override switch 204 is provided so that the operator may activate the switch to turn off the chime, if so desired.

In order to insure that the operator hears the chime 202, the microcomputer 80 is programmed to respond to its broadcast code to activate a radio speaker mute control 206 to mute the radio speaker or speakers in the vehicle for a time sufficient for the operator to hear the audible signal from the chime 202.

Figure 5:
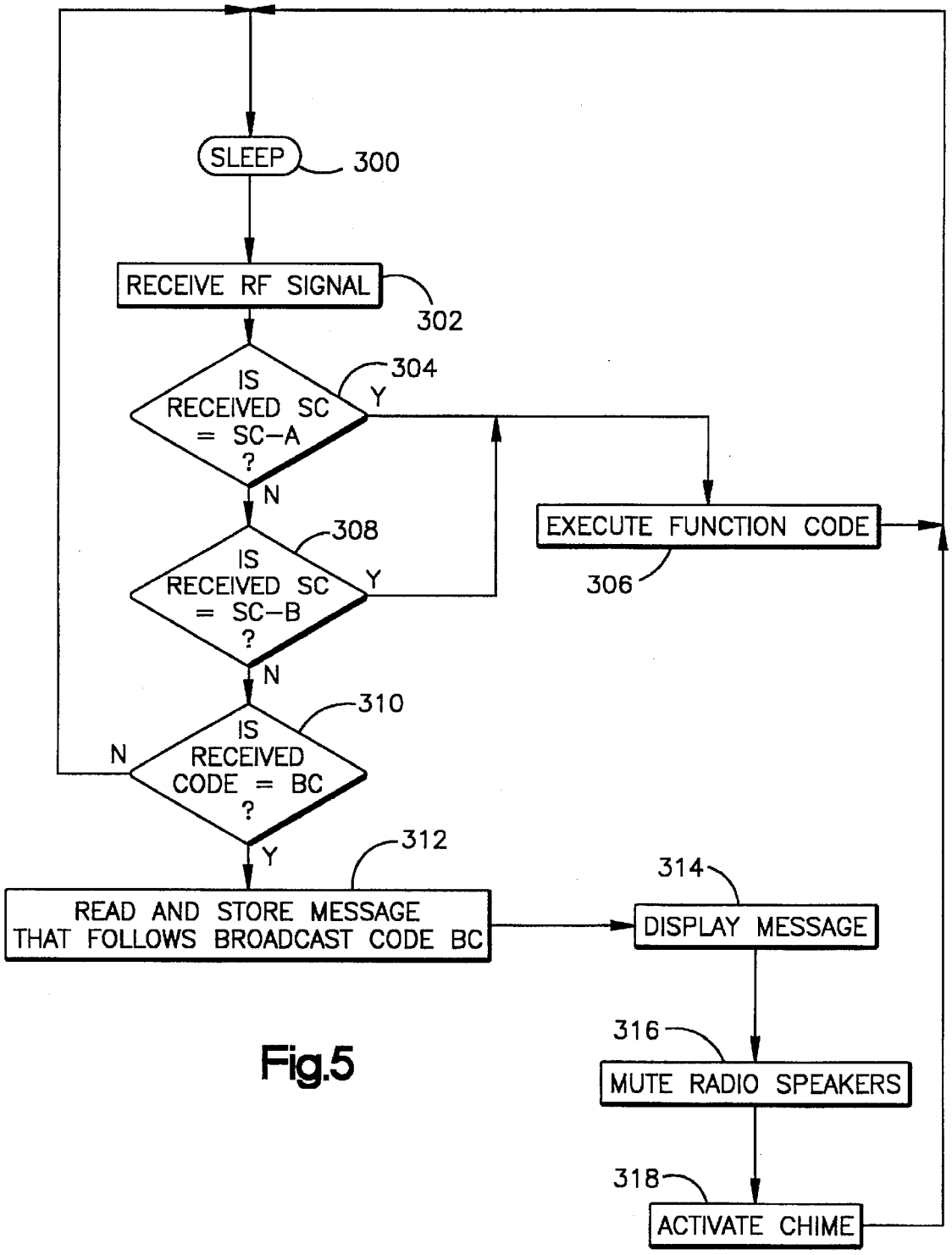
FIG. 5 is a flow diagram illustrating the operation of the receiver herein.

Reference is now made to FIG. 5 which illustrates a flow chart showing the manner in which the microcomputer in the receiver C is programmed in accordance with the present invention. Initially, in accordance with step 300, the receiver C is in a power down standby condition awaiting reception of a signal from a transmitter, such as a transmitter on the emergency vehicle 14 or one of the roadside transmitters 18 and 20 or an RKE transmitter TA or TB. Upon receipt of such a signal, the initial bits received will activate the wake up signal detector 72 and will cause the wake up circuit 74 to power up and provide power to the microcomputer 80. In accordance with step 302, the microcomputer is programmed to receive the signal and read the incoming digital signal and store same in temporary registers in the microcomputer.

In accordance with step 304, the microcomputer is programmed to compare the code portion 62 of the received signal with the security code SC-A stored in the security code register 100. If a match takes place, then, in accordance with step 306, the computer is programmed to execute the function code, as, for example, by causing the vehicle door to unlock. If a match did not take place in step 304, then, in accordance with step 308, a comparison is made to determine if the received code is equal to stored security code SC-B. If a match takes place in step 308, then program control Jumps back to step 306, wherein the function code following the security code is executed to perform the requested function, as, for example, by causing the vehicle door to unlock.

If the coded portion does not match either security code SC-A or security code SC-B, then, in accordance with step 310, the received coded portion of the signal is compared with the stored broadcast code BC. If a match does not take place, then the receiver reverts to its "sleep" condition to await receipt of a new signal from a transmitter. If a match does take place, then, in accordance with step 312, the message in the message portion 64 that follows the broadcast code is read and stored in the microcomputer memory. Thereafter, this message in accordance with step 314, is displayed on the message display 200. To be sure that the operator pays attention to the chime, the radio speaker mute controls 206 are activated, in accordance with step 316, to mute the radio speakers for a predetermined period of time. This is done before the chime is activated. A chime 202 is activated in accordance with step 318 to provide an audible alert to the operator so that he will pay attention to the message display 200.

In the description presented above, the message that follows the broadcast code is a multiple character message for providing the driver with information. It is contemplated that the system could be simplified to some extent, however, by using dashboard indicator lights instead of an alphanumeric display. In such a system, the transmitted public signal would not take the described form including a broadcast code and separate,message. Instead, the public signal should merely communicate one of a plurality of alert codes, each representing a certain predetermined category of events. The microprocessor would light one of the indicator lamps, depending upon which of the alert codes were received. Alternatively, the message could be presented audibly in the form of a voice message generated by the vehicle car speaker system. In such a system, the voice message could be one of several voice messages stored in the programmable memory of the microcomputer in compact digitized form and selected by the particular alert code received by the system. Also, the voice message could instead be transmitted in digitized format after transmission of the broadcast code. In either case, the microcomputer would convert the digitized signal into an audio signal and insert the audio signal into the car radio amplifier in place of the signal from the conventional AM-FM tuner.

From the above description of the invention, those skilled in the art will perceive improvements, changes and modifications. Such improvements, changes and modifications within the skill of the art are intended to be covered by the appended claims.

Having described the invention, the following is claimed:

1. A remote keyless entry system vehicle receiver for use in a vehicle comprising:

means storing a security code uniquely identifying a transmitter that is authorized entry into said vehicle and storing a broadcast code identifying a broadcast message intended for general common use by at least a group of vehicles that are each equipped with said receiver;

means for receiving a signal having at least a coded portion;

means for comparing said coded portion of said received signal with each of said stored codes; and means for controlling access to said vehicle when said received signal includes said coded portion that matches said stored security code; and, means for controlling the providing of a message associated with said broadcast code and common to said group of vehicles when said received signal includes said coded portion that matches said stored broadcast code, said message being provided independent of said coded portion matching said stored security code.

2. A vehicle receiver as set forth in claim 1 including information display means for displaying visual information to a vehicle operator when said coded portion matches said stored broadcast code.

3. A vehicle receiver as set forth in claim 1 including audible means for providing an audible indication when said received signal includes said coded portion that matches said stored broadcast code.

4. A vehicle receiver as set forth in claim 3 including manually operable override means for deactivating said audible means.

5. A vehicle receiver as set forth in claim 3 including information display means for providing a video display along with said audible indication when said received signal includes said coded portion that matches said stored broadcast code.

6. A vehicle receiver as set forth in claim 1 wherein said receiving means includes means for receiving said signal having said coded portion as well as a second portion wherein said second portion includes multiple character message information following said coded portion when said coded portion matches said stored broadcast code, said receiving means including means for storing said multiple character message information following said coded portion.

7. A vehicle receiver as set forth in claim 6 including a message display for displaying a multiple character message in accordance with said received multiple character message information.

8. A vehicle receiver as set forth in claim 7 including audible means for providing an audible indication to a vehicle operator when said received signal includes said coded portion that matches said stored broadcast code.

9. A vehicle receiver as set forth in claim 8 including manual override means for deactivating said audible means.

10. A vehicle receiver as set forth in claim 7 including vehicle speaker mute control means to initiate deactivation of a vehicle radio speaker when said received signal includes said coded portion that matches said stored broadcast code.

11. A remote keyless entry system vehicle receiver for use in a vehicle comprising:

a first memory register storing a security code uniquely identifying a transmitter that is authorized entry into said vehicle and a second memory register storing a broadcast code identifying a broadcast message intended for general common use by at least a group of vehicles that are each equipped with said receiver;

means for receiving a signal having at least a coded portion;

means for comparing said coded portion of said received signal with each of said stored codes;

access control means for controlling access to said vehicle when said received signal includes said coded portion that matches said stored security code; and, message control means for controlling the providing of a message associated with said broadcast code when said received signal includes said coded portion that matches said stored broadcast code, said message being provided independent of said coded portion matching said stored security code.

* * * * *